United States Patent [19]

Nathanson

[11] 3,998,002

[45] Dec. 21, 1976

[54] PANEL HOLDER FOR SMALL STRUCTURES AND TOYS

[76] Inventor: Albert Nathanson, 249 - 26 63rd Ave., Little Neck, N.Y. 11329

[22] Filed: Jan. 29, 1975

[21] Appl. No.: 544,949

[52] U.S. Cl. ..... 46/17; 46/30; 46/31

[51] Int. Cl.[2] ..... A63H 33/10

[58] Field of Search ..... 46/30, 31, 17

[56] References Cited

UNITED STATES PATENTS

| | | | |
|---|---|---|---|
| 1,648,706 | 11/1927 | Walker | 46/31 |
| 2,042,007 | 5/1936 | Kennedy | 46/31 |
| 2,921,347 | 1/1960 | Solomon | 46/17 |
| 3,069,806 | 12/1962 | Wright et al. | 46/30 |
| 3,355,837 | 12/1967 | Pederson | 46/17 |
| 3,618,991 | 11/1971 | Edwards | 46/31 |

FOREIGN PATENTS OR APPLICATIONS

| | | | |
|---|---|---|---|
| 1,067,616 | 1/1954 | France | 46/36 |

*Primary Examiner*—Russell R. Kinsey
*Assistant Examiner*—Robert F. Cutting
*Attorney, Agent, or Firm*—Richard L. Miller

[57] ABSTRACT

A novel clamping device which is particularly adaptable for grasping flat members such as panels, and which accordingly is ideal as a component in a child's construction toy or which may be used in the erection of an actual wall or partition of a housing or building; the clamping device consisting of one or more sets of clips integrally formed together and with a sleeve slidable onto a peg or post.

3 Claims, 11 Drawing Figures

PANEL HOLDER FOR SMALL STRUCTURES AND TOYS

This invention relates generally to clamping devices. More specifically it relates to panel holders for small structures and toys.

A principle object of the present invention is to provide a panel holder that is designed to particularly grasp flat objects such as panels and which also incorporates a sleeve portion so that the panel holder can be support around a post or peg.

Another object is to provide a panel holder which accordingly can be incorporated as a component in a child's construction toy or which, otherwise, can be used in the actual construction of a house or building partition or wall.

Yet another object is to provide a panel holder which can be made of any material so to suit the particular purpose, and which in a child's construction toy is preferably made of inexpensive molded plastic or which in an actual house or building construction may be made either of wood, metal or plastic.

Other objects are to provide a panel holder for small constructions and toys which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
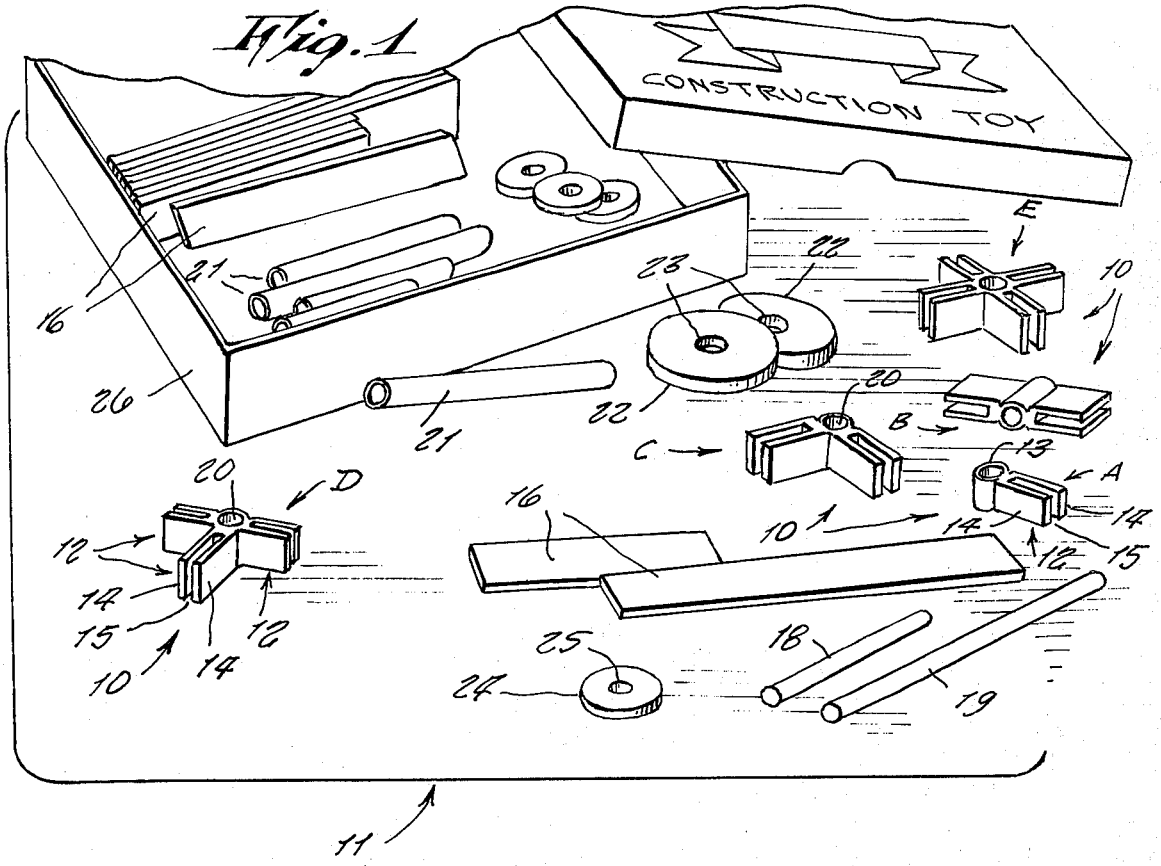
FIG. 1 is a perspective view of the invention applied to a construction toy.
Figure 2:
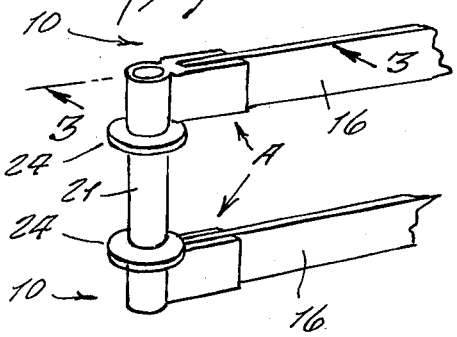
FIG. 2 is a detail of some of the parts secured together.

Referring now to the drawings in detail, and more particularly to FIGS. 1 through 5 thereof at this time, the reference numeral 10 represents a panel holder according to the present invention wherein the same is shown as a member of a construction toy 11.

The panel holder may be made in any of several different models in order that it may grasp either one or a plurality of panels. In its simplest form it is shown at A for grasping a single flat panel or object. The model A of panel holder 10 is comprised of a single clip element 12 and a sleeve element 13 integrally formed together. The clip element 12 consists of a pair of parallel, spaced apart jaws 14 forming a mouth 15 therebetween in which a flat object such as a flat strip or panel 16 can be grasped by the jaws, such as is shown in the examples illustrated in FIGS. 2 and 3.

In FIG. 1, other models of the panel holder 10 are also shown which are capable of grasping a plurality of panels and hold them at specific angles respective to each other. Thus, a model B is designed to grasp a pair of panels on a same plane by having clip elements 12 on diametrically opposite sides of the sleeve element. Another model C is designed to grasp a pair of panels and retain them at right angles to each other. Another model D is designed to retain three panels at 90° to each other by having three clip elements disposed 90° apart. A further model E has four clip elements equidistant apart so to retain four panels 90° apart from each other. It is to be readily understood that the present invention may relate to other panel holders having any other number of clip elements and at any other angles, equidistant or unequidistant apart.

Figure 3:
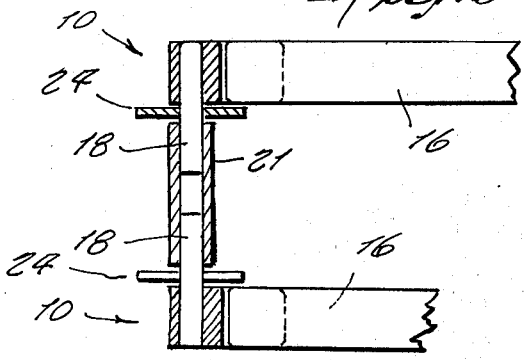
FIG. 3 is a cross section on line 3—3 of FIG. 2.
Figure 4:
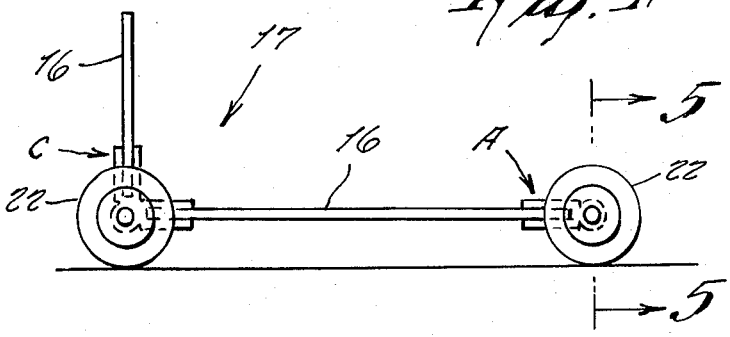
FIG. 4 is a side view of a toy vehicle made of the parts.
Figure 5:
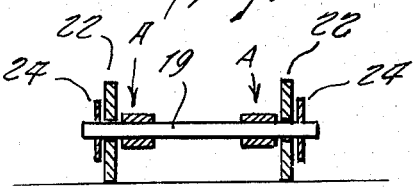
FIG. 5 is a cross section on line 5—5 of FIG. 4.
Figure 6:
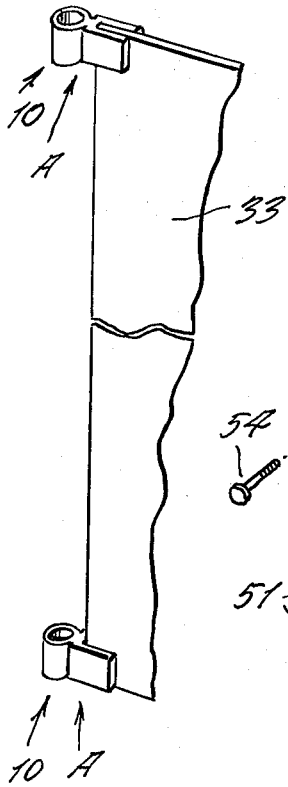
FIG. 6 is a detail of the invention applied to a building construction panel.

In order that the above described models of panel holders may be used in the construction toy 11, the toy is made to include components that are readily engagable thereby so that all manner of different objects may be constructed, such as a house, bridge, or a vehicle 17 as shown in FIGS. 4 and 5. Such components include different lengths of pegs 18 and posts 19 that frictionally fit inside the sleeve element opening 20, a tube 21 in which the ends of the pegs or posts are frictionally engagable in order to enjoin pegs as shown in FIG. 3, and also the panels 16 for being grasped by the clip elements. Additionally, the toy also includes larger wheels 22 having central openings 23 for fitting frictionally free on the pegs or posts so that the wheels are free to rotate, and also small circular discs 24 having central openings 25 that frictionally fit on the pegs and posts so to serve the purpose of nuts to retain wheels on the pegs or posts that thus serve as wheel shafts. All the components fit into a box 26 which also may include an instruction booklet informing how to use the various parts in order to construct different objects.

Figure 7:
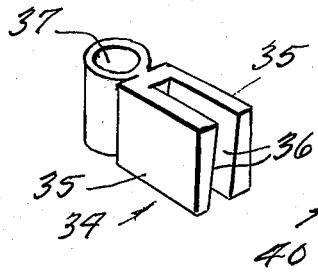
FIG. 7 is a view of a modified design of the clip member which when used along a panel as shown in FIG. 6 provides a twisting tight grip.
Figure 8:
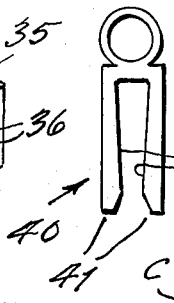
FIG. 8 is another modified design thereof.
Figure 9:
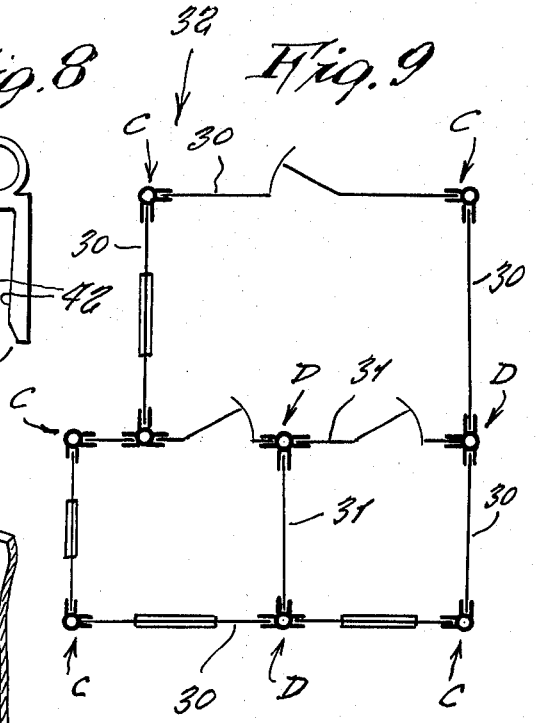
FIG. 9 is a plan view of a housing using the present invention.

In FIGS. 6 to 11, the present invention designed for practical application in actual panel construction of a house or building such as when putting up walls or partitions. Thus as shown in FIG. 9, the panel holders 10 are used to retain upright the outside walls 30 and partitions 31 of the house 32; the panels comprising large sheets of sheet rock 33 or the like and which may measure 4 by 8 feet.

In FIG. 7, a modified design of the invention shows a panel holder 34 in which the clip element jaws 35 each has a face 36 facing each other; the faces being parallel to each other but being at an inclined angle respective to an axis of the sleeve element opening 37 accordingly, when two such panel holders are clipped along spread apart positions along a same side edge of a flat panel the axis of their openings 37 do not align on a same axis so that when a single post is forced through both, the clip elements give a twisting thrust to their grasp of the panel, thus holding it more securely so it cannot slip out as easily.

In FIG. 8, another design of panel holder 40 shows jaws 41 having faces 42 that are at an angle respective to each other; the faces converging at the outer end tips of the jaws. The jaw ends are rounded off so to allow easy insertion of a panel into the mouth between the jaws.

Figure 10:
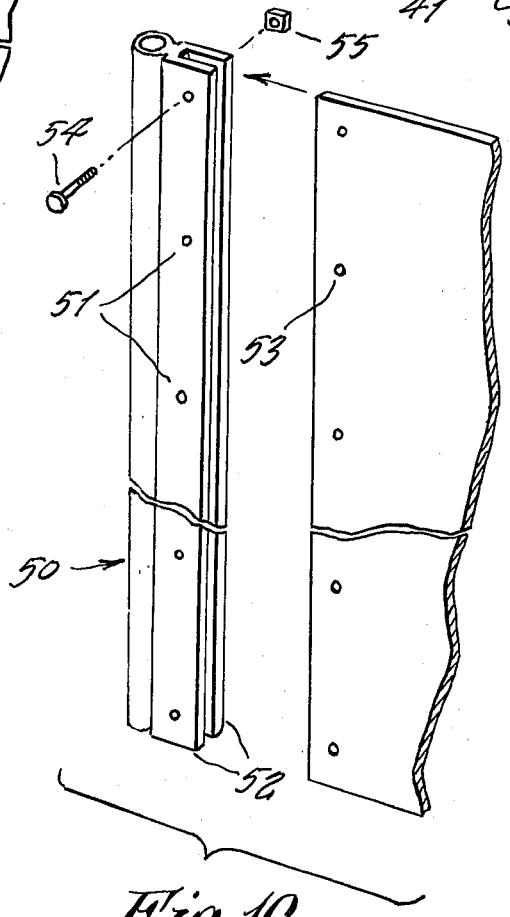
FIG. 10 is another modified design of the clip which runs the length of a panel.

In FIG. 10, a panel holder 50 is shown that is a full length of the edge of a panel to which it is attached. Openings 51 through both jaws 53 of the holder align with openings 53 of the panel so to receive bolts 54 fitted with nuts 55.

Figure 11:
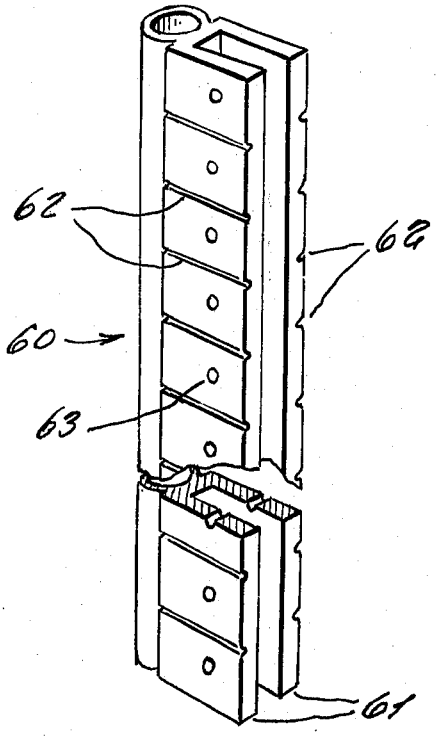
FIG. 11 is a production clip unit in which individual clips can be broken off.

The panel holder 60 shown in FIG. 11 is the same as panel holder 50 except that its jaws 61 includes a series of transverse grooves 62 between the bolt openings 63 so to easily break the holder along any groove whereby the holder can be quickly made in any desired length. The holder is, of course, made of a breakable material, such as plastic or other breakable substance.

Thus various forms of panel holders have been shown that are adaptable for use in construction toys as well as in house structures.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a panel holder, the combination of at least a single clip element and a sleeve element integrally secured together, said clip element consisting of a pair of spaced jaws forming a mouth therebetween, a flat panel fitted in said mouth being grasped frictionally by said jaws, and a peg or post frictionally fitted in an opening of said sleeve element, a longitudinal axis of said peg or post being at right angle to a direction into which said jaws extend, wherein a plurality of said panel holders having different numbers of said clip elements, comprise components of a construction toy, said toy also including a plurality of said panels of different sizes, a plurality of said pegs and said poles in various lengths, a plurality of tubes of various lengths for enjoining said plurality of pole or pegs, a plurality of wheels for frictionless fit on said poles or pegs, and a plurality of discs for friction fit on said poles or pegs, some of said panel holders having a different number of said clip elements than other of said panel holders, and said clip elements in some said panel holders being equidistant apart, while said clip elements in other said panel holders being unequidistant apart.

2. The combination as set forth in claim 1 wherein said spaced apart jaws having facing sides that are parallel to each other but are inclined respective to an axis of said sleeve element opening.

3. The combination as set forth in claim 1 wherein said panel holder is as long as an elongated edge of said panel.

* * * * *